US006478885B1

(12) United States Patent
Goodreau

(10) Patent No.: US 6,478,885 B1
(45) Date of Patent: Nov. 12, 2002

(54) PHOSPHATING PROCESSES AND PRODUCTS THEREFROM WITH IMPROVED MECHANICAL FORMABILITY

(75) Inventor: Bruce H. Goodreau, Romeo, MI (US)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/674,942

(22) PCT Filed: May 7, 1999

(86) PCT No.: PCT/US99/07026

§ 371 (c)(1),
(2), (4) Date: Nov. 8, 2000

(87) PCT Pub. No.: WO99/58742

PCT Pub. Date: Nov. 18, 1999

Related U.S. Application Data

(60) Provisional application No. 60/084,781, filed on May 8, 1998.

(51) Int. Cl.[7] ..... C23C 22/00; B32B 33/00

(52) U.S. Cl. ..... 148/250; 148/251; 148/253; 148/259; 148/262; 148/263; 148/273; 148/274; 428/472.3; 428/908.8

(58) Field of Search ..... 428/467, 469, 428/472.3, 621, 626, 628, 908.8; 148/250, 251, 253, 259, 262, 263, 273, 274, 284

(56) References Cited

U.S. PATENT DOCUMENTS

| | | | | | |
|---|---|---|---|---|---|
| 3,957,543 | A | * | 5/1976 | Shinomiya et al. | 148/250 |
| 3,977,912 | A | * | 8/1976 | Smadja et al. | 148/250 |
| 3,985,584 | A | * | 10/1976 | Chan et al. | 428/626 |
| 4,017,335 | A | * | 4/1977 | Maloney | 148/250 |
| 4,321,308 | A | * | 3/1982 | Jahnke | 428/469 |
| 4,381,249 | A | * | 4/1983 | Bouffard | 148/259 |
| 5,103,550 | A | * | 4/1992 | Wefers et al. | 148/253 |
| 5,458,698 | A | * | 10/1995 | Bershas et al. | 148/274 |
| 5,624,888 | A | * | 4/1997 | Przybylski et al. | 148/250 |

* cited by examiner

*Primary Examiner*—Robert R. Koehler
(74) *Attorney, Agent, or Firm*—Stephen D. Harper; Arthur G. Seifert

(57) ABSTRACT

When a phosphate ester or a dispersed wax is added to a conventional liquid phosphate conversion coating composition, the resulting phosphate coating formed on a metal substrate has a lower coefficient of friction after being oiled than it would have had if the additive had been omitted. The corrosion resistance and paint adhesion properties expected from the conversion coating are not substantially diminished by the additive. Particularly good results are achieved if the phosphate coating composition contains calcium and ferrous cations and the liquid phosphate conversion coating composition is dried into place on the substrate.

20 Claims, No Drawings

PHOSPHATING PROCESSES AND PRODUCTS THEREFROM WITH IMPROVED MECHANICAL FORMABILITY

This application is the U.S. National Phase application of and claims priority from International Application Number PCT/US99/07026, filed May 7, 1999, which was published under PCT Article 21(2) in English. This application also claims priority from U.S. provisional application serial No. 60/084,781, filed May 8, 1998, which priority was also claimed in said International Application.

BACKGROUND OF THE INVENTION

This invention relates to a generically well known process variously called "phosphating", "phosphatizing", or "phosphate conversion coating" in which a metallic substrate is coated with an adherent coating containing phosphate anions and metal cations, at least some of these metal cations being those corresponding to one or more metallic constituent(s) of the substrate. If the phosphating composition also contains divalent cations that can form only sparingly water-soluble phosphates, the conversion coating formed also normally includes some of these divalent cations from the phosphating composition.

Normally, a phosphate coating is formed by chemical reaction between the metal substrate and an aqueous liquid variously called a "phosphating" or "phosphatizing" composition, solution, bath, or a like term; in some instances, the formation of the coating may be aided by, or even completely dependent on, application of an electric current. If the phosphating composition is in contact with the substrate for at least about five seconds at a temperature not more than 70° C. and any liquid phosphating composition remaining in contact with the conversion coating thus formed is rinsed off before the substrate treated with it is dried, the phosphate coating formed generally is microcrystalline, particularly if the substrate and/or the phosphating composition contains substantial amounts of iron and/or zinc. If the phosphating composition is applied to the substrate and dried in place without rinsing, the coating formed is usually predominantly amorphous.

The presence of a phosphate coating on a metal substrate normally serves one or both of two major functions: (1) increasing the corrosion resistance of the substrate by comparison with an otherwise identical metal substrate that has no such conversion coating, an increase that may be measured either with or without a subsequent paint or similar protective coating and (2) serving as a strongly adherent "carrier" for an externally applied lubricant material that facilitates mechanical cold working.

A major object of this invention is to achieve an additional benefit from a phosphate conversion coating in an operation of this latter type. The specific benefit achieved is a reduction in the coefficient of sliding friction of the conversion coated and lubricated surface, compared to the surface achieved with a conventional phosphate conversion coating that is lubricated in the same manner. Such a reduction in surface friction facilitates relatively minor mechanical formability such as is needed for stamping, bending into corners, and the like, particularly for such operations that are involved in the manufacture of automobile body parts, appliances, metal furniture, and the like from suitably prepared metal sheets and/or coils, normally without substantially reducing the thickness of the sheet or coil material used over most of its area. In some instances, this reduction of the coefficient of the coated substrate preferably is achieved without sacrificing the corrosion protective qualities of a conventional phosphate coating applied for this purpose. In many instances, however, this is a relatively minor consideration, because the substrates initially coated with a phosphate-containing coating to facilitate the mechanical working are coated with another corrosion protective conversion coating, after they have been put into their final intended shape. Other more detailed objects of the invention will become apparent from the description below.

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, throughout the description, unless expressly stated to the contrary: percent, "parts of", and ratio values are by weight or mass; the term "polymer" includes "oligomer", "copolymer", "terpolymer" and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ within the composition by chemical reaction(s) noted in the specification between one or more newly added constituents and one or more constituents already present in the composition when the other constituents are added, and does not preclude unspecified chemical interactions among the constituents of a mixture once mixed; specification of constituents in ionic form additionally implies the presence of sufficient counterions to produce electrical neutrality for the composition as a whole and for any substance added to the composition; any counterions thus implicitly specified preferably are selected from among other constituents explicitly specified in ionic form, to the extent possible; otherwise such counterions may be freely selected, except for avoiding counterions that act adversely to an object of the invention; the word "mole" means "gram mole", and the word itself and all of its grammatical variations may be used for any chemical species defined by all of the types and numbers of atoms present in it, irrespective of whether the species is ionic, neutral, unstable, hypothetical, or in fact a stable neutral substance with well defined molecules; an abbreviation once defined may be used thereafter with either exactly the same meaning or a grammatically varied meaning as indicated by the context and is to be understood as having the same meaning, mutatis mutandis, as when first defined; and the terms "solution", "soluble", "homogeneous", and the like are to be understood as including not only true equilibrium solutions or homogeneity but also dispersions that show no visually detectable tendency toward phase separation over a period of observation of at least 100, or preferably at least 1000, hours during which the material is mechanically undisturbed and the temperature of the material is maintained within the range of 18–25° C.

BRIEF SUMMARY OF THE INVENTION

It has been found that the above stated object of the invention can be achieved by combining with a conventional phosphating composition an additive selected from the group consisting of (i) water-soluble and water-dispersible phosphate esters and (ii) natural and synthetic waxes that are water-dispersible and are not phosphate esters. Specific embodiments of the invention include phosphating compositions containing one or more of these additives, processes for forming a phosphate conversion coating from such a phosphating composition and a metal substrate, and articles of manufacture including surfaces treated by such a process and/or surfaces having a phosphate conversion coating that includes one or more of these additives.

DETAILED DESCRIPTION OF THE INVENTION

Non-exclusive examples of conventional phosphating compositions suitable for combining with additives to produce a composition according to this invention include those described in the following U. S. patents and applications therefor, the entire disclosures of which, except to any extent that they may be inconsistent with any explicit statement herein or with other more recently developed knowledge in the art, are hereby incorporated herein by reference: U.S. application Ser. No. 08/464,609; U.S. Pat. Nos. 6,071,435 5,932,292; 5,900,073; 5,891,268; 5,807,442; 5,776,265; U.S. Pat. No. RE 35,958 PCT application Ser. Nos. US96/19144; and US96/02677; and U.S. Pat. Nos. 5,645,650; 5,683,816; 5,595,611; 5,498,300; 5,472,522; 5,451,271; 5,378,292; 5,261,973; 5,143,562; 5,125,989; 5,082,511; 5,073,196; 5,045,130; 5,000,799; 4,992,116; 4,961,794; 4,927,472; 4,880,467; 4,874,480; 4,849,031; 4,722,753; 4,717,431; 4,673,444; 4,643,778; 4,639,295; 4,637,838; 4,612,060; 4,596,607; 4,595,424; 4,565,585; 4,559,087; 4,539,051; 4,529,451; 4,517,029; 4,515,643; 4,486,241; 4,443,273; 4,419,199; 4,419,147; 4,416,705; 4,402,765; 4,385,096; 4,377,487; 4,338,141; 4,311,535; 4,292,096; 4,289,546; 4,265,677; 4,220,486; 4,142,917; 4,108,690; 4,063,968; 3,939,014; 3,932,287; 3,870,573; 3,860,455; 3,850,700; 3,839,099; 3,795,548; 3,758,349; 3,723,334; 3,723,192; 3,706,604; 3,697,332; 3,671,332; 3,645,797; 3,619,300; 3,615,912; 3,607,453; 3,573,997; 3,565,699; 3,547,711; 3,533,859; 3,525,651; 3,519,495; 3,519,494, 3,516,875; 3,515,600; 3,493,400; 3,484,304; U.S. Pat. No. Re 27,896; U.S. Pat. Nos. 3,467,589; 3,454,483; 3,450,579; 3,450,578; 3,450,577; 3,449,222; 3,444,007; 3,401,065; 3,397,093; 3,397,092; 3,380,859; 3,338,755; 3,297,493; 3,294,593; 3,268,367; 3,240,633; 3,218,200; 3,197,344; 3,161,549; 3,154,438; 3,146,133; 3,133,005; 3,101,286; 3,046,165; 3,015,594; 3,007,817; 2,979,430; 2,891,884; 2,882,189; 2,875,111; 2,840,498; 2,835,618; 2,835,617; 2,832,707; 2,819,193; 2,813,814; 2,813,813; 2,813,812; 2,798,829; 2,758,949; 2,744,555; 2,743,204; 2,724,668; 2,702,768; 2,665,231; 2,657,156; 2,609,308; 2,591,479, 2,564,864; 2,540,314; 2,298,312; 2,298,280; 2,245,609; 2,132,883; 2,121,574; 2,121,520; 2,120,212; 2,114,151; 2,076,869; 1,660,661; 1,654,716; 1,651,694; 1,639,694; 1,610,362; 1,485,025; 1,388,325; 1,377,174; 1,341,100; 1,320,734; 1,317,351; 1,292,352; 1,290,476; 1,287,605; 1,254,264; 1,254,263; 1,248,053; 1,219,526; 1,215,463; and 1,206,075.

When a composition according to this invention is applied by the dry-in-place method, the concentration of the various ingredients in it has little or no effect by itself on the quality of the protection obtained, which instead depends more on the total amount of the active ingredients put into place on each unit area of the surface, the ratios among the active ingredients, and the time and temperature of drying. Accordingly, the preferred concentrations will be described primarily below in terms of the compositions as likely to be sold, which are called "concentrates" herein, even though they may be used without further dilution in many instances. These concentration preferences are depended primarily on reconciling the goals of shipping economy, which would favor the highest possible concentrations of the active ingredients that are consistent with the preferred ratios among such ingredients and the maximum solubilities or dispersibilities of the ingredients in water, and storage stability, which generally favors somewhat lower concentrations than the maximum possible ones, to reduce the danger of precipitation, flocculation, settling, or other evidences of development of inhomogeneity in the stored compositions. Generally preferred concentration ranges for working compositions to be used by drying-in-place are from 20 % solutions in water of the concentrate compositions described explicitly below up to direct use of these concentrates. For other types of processing conditions, guidance as to preferred working compositions may be obtained by using the preferred conditions taught by the prior art, for use in the manner selected, of a conventional phosphating composition that is similar to the particular composition according to the invention that is in use, except for the presence of the characteristic additive in a composition according to the invention.

A composition according to the invention preferably includes, as part of its conventional phosphating composition, calcium cations supplied by dissolving into at least part of the water base of the composition a soluble or reactive salt or hydroxide of calcium. Primarily for reasons of economy and/or avoidance of possibly troublesome impurities, calcium carbonate is usually preferred as the source of calcium. In a concentrate composition according to the invention, there preferably is a concentration of calcium of at least, with increasing preference in the order given, 0.05, 0.10, 0.15, 0.20, 0.25, 0.30, 0.35, 0.40, or 0.42 moles of calcium per kilogram of the concentrate composition, a concentration unit that may be used herein for any solute or dispersate in any homogeneous composition as well as for calcium in a concentrate composition and is hereinafter usually abbreviated as "M/kg". Independently, the concentration of calcium in a concentrate composition according to the invention preferably is not more than, with increasing preference in the order given, 10.0, 6.0, 4.0, 3.0, 2.5, 2.0, 1.60, 1.40, 1.30, 1.20, 1.10, or 1.05 M/kg.

Independently, a concentrate composition according to the invention preferably contains iron cations, which preferably are in the ferrous oxidation state, inasmuch as ferrous phosphate is considerably more water soluble than ferric phosphate. The concentration of iron when present preferably is at least, with increasing preference in the order given, 0.10, 0.20, 0.35, 0.50, 1.0, 1.5, 1.6, 1.9, or 2.1 grams of iron per kilogram of total concentrate composition, a concentration unit that may be used hereinafter for any other constituent as well as for iron and is hereinafter usually abbreviated as "ppt" (for "parts per thousand"), and independently preferably is not more than, with increasing preference in the order given, 30, 25, 20, 10, 7.5, 5.0, 4.0, 3.5, 3.1, or 2.9 ppt. Any iron present is preferably added in the form of ferrous sulfate, inasmuch as the amounts of sulfate thus introduced into the composition are believed to have a positive effect on the storage stability of a phosphating composition.

A composition according to the invention may contain any of the divalent cations, such as those of zinc, manganese, nickel, cobalt, magnesium, copper, and the like, often found useful in conventional phosphating compositions. The presence of these materials in conventional amounts appears to have little effect on the results achieved in reducing the coefficient of friction according to this invention, but of course, if the phosphate containing coating applied in a process according to the invention is not later covered over by a phosphate conversion coating applied after the substrate being treated has been formed into its final intended shape, is expected to have a substantial effect on the corrosion resistance achieved in various environments, as generally known from the conventional phosphating art; for example, phosphate coatings that are to be used as a base for cathodically electrodeposited paint and then exposed to outdoor atmospheres preferably contain zinc and manganese ions in order to maximize their corrosion resistance.

A composition according to the invention must contain phosphate anions. They may be supplied to the composition by any oxyacid of phosphorus, or water-soluble salt thereof, in which the phosphorus is in its +5 valence state, i.e., orthophosphoric acid, metaphosphoric acid, and the condensed phosphoric acids corresponding to the general formula $H_{(n+2)}P_nO_{(3n+1)}$, where n represents a positive integer with a value of at least 2. As is generally known in the art, these species are all believed to exist in equilibrium with one another, with the equilibrium strongly favoring orthophosphoric acid and/or its salts at low temperatures and concentrations and favoring the more condensed acids, including metaphosphoric acid, and/or their salts at higher temperatures and concentrations. At least for reasons of economy, simple orthophosphoric acid, for which the chemical formula is $H_3PO_4$, and/or at least one salt thereof, is normally preferred as the source for the phosphate ions in a composition according to this invention. The concentration of phosphate ions in a working composition according to the invention preferably is at least, with increasing preference in the order given, 0.20, 0.40, 0.80, 1.2, 1.6, 2.0, 2.3, or 2.5 M/kg and independently preferably is not more than, with increasing preference in the order given, 7.0, 6.5, 6.0, 5.5, 5.0, 4.5, 4.0, 3.5, 3.2, or 3.0 M/kg. In testing whether a composition conforms to one of these preferences, the stoichiometric equivalent as phosphate ions of all sources of pentavalent phosphorus dissolved in a composition according to the invention is to be considered present as phosphate ions, irrespective of the actual extent of ionization, complex formation, or the like.

As with conventional phosphating practice, when the substrates to be treated are predominantly zinciferous or similarly electrochemically active, no accelerator is generally needed in the conventional phosphating composition part of a composition according to the invention, while if the substrates are predominantly ferriferous, an accelerator may be advantageous, although not strictly required if the treatment is to be by drying in place as is generally preferred. Adequate guidance as to suitable accelerators is provided by the prior phosphating art.

Phosphate esters that are used as the additive according to the invention preferably are esters of alcohols, more preferably monoalcohols, that include a block of polyoxyethylene between their hydroxyl group(s) and any other carbon atoms that are in the molecule and are not part of the polyoxyethylene. Such esters are readily available commercially as surfactants. Mono-, di-, and trimesters are all satisfactory and are likely to occur in practice in all commercial products, although materials with a predominance of either mono- or tri-mesters are generally available from most suppliers. More preferred phosphate esters are esters of alcohols that (i) include on average in each molecule a block of polyoxyethylene that contains at least, with increasing preference in the order given, 2, 3, 4, 5, or 6 oxyethylene units in the block and independently preferably contains not more than, with increasing preference in the order given, 12, 10, 9, 8, or 7 oxyethylene units in the block and (ii) also include in each molecule a hydrophobe portion, bonded to one end of the polyoxyethylene block, the hydrophobe portion containing only carbon and hydrogen atoms, and, optionally, halogen atoms, the number of carbon atoms in the hydrophobe portion preferably being at least, with increasing preference in the order given, 6, 7, or 8, and independently preferably being not more than, with increasing preference in the order given, 18, 16, 14, 12, or 10. Primarily for reasons of economy, the hydrophobe portion preferably does not contain halogen atoms.

Any of a wide variety of emulsifiable natural and synthetic waxes and water-insoluble polymers may be used as the characteristic additive of the invention. Many such materials are readily available commercially and are believed to find their major use in the floor and furniture maintenance industry and as paint additives. The natural and synthetic waxes, exclusive of phosphate esters as described above, for use in this invention preferably have each of the following characteristics, independently for each characteristic, but most preferably have all of them: (i) a melting point that is not lower than, with increasing preference in the order given, 40, 45, 50, 55, or 60° C.; (ii) no visual evidence of decomposition when maintained, in contact with the natural atmosphere, at a temperature 5° C. greater than the melting point for a time that is at least, with increasing preference in the order given, 0.05, 0.10, 0.20, 0.40, 0.50, 1.0, 3.0, or 10 days; (iii) a true solubility, as distinguished from dispersibility, in water at 25° C. that is not greater than, with increasing preference in the order given, 10, 7.0, 5.0, 3.0, 1.0, 0.70, 0.50, 0.30, or 0.20% of the wax in the saturated solution; and (iv) a viscosity at a temperature 5° C. above the melting point that is not greater than, with increasing preference in the order given, 10,000, 5000, 3000, 2000, 1000, 700, 500, 400, 300, 200, or 100 centipoises. Examples of suitable types include oxidized and non-oxidized polyethylene and polypropylene waxes, paraffin waxes, acid waxes, ester waxes, montan waxes, carnauba waxes, copolymers of ethylene with vinyl acetate and/or acrylic monomers, and halocarbon, especially fluorocarbon, polymers. Materials that are emulsified with cationic emulsifying agents are preferred because they are generally more stable, although nonionic and anionic emulsifying agents can also be used. Oxidized crystalline polyethylene waxes are preferred. Independently, the waxes used in a composition according to this invention preferably have a weight average molecular weight that corresponds to the presence of at least, with increasing preference in the order given, 25, 30, 35, 40, 45, 50, 100, 200, 300, 400, 500, 600, or 700 carbon atoms per molecule.

Relatively small concentrations of wax and/or phosphate ester additives are preferred in a concentrate composition according to the invention. More specifically, the concentration of phosphate esters, when these are used as the additives, measured on a non-volatiles basis, in a concentrate composition according to the invention preferably is at least, with increasing preference in the order given, 3.0, 5.0, 10, 15, 20, 25, 30, 33, 36, or 38 ppt and independently preferably is not more than, with increasing preference in the order given, 300, 240, 180,120, 80, 65, 55, 50, 45, 42, or 40 ppt. If waxes that are not phosphate esters are used, the concentration of the waxes in a concentrate composition according to the invention preferably is at least, with increasing preference in the order given, 0.5, 1.0, 2.0, 3.0, 4.0, 5.0, or 6.0 ppt and independently, primarily for reasons of economy, preferably is not more than, with increasing preference in the order given, 60, 50, 40, 30, 20, 15, 12, or 10 ppt.

A process according to this invention is preferably performed by a dry-in-place method; i.e., a liquid layer of a composition according to the invention is preferably formed over the substrate surface to be treated in the process and then dried into place without any intermediate rinsing, so that the entire non-volatiles content of the liquid layer initially formed, possibly modified by chemical reaction with the surface being treated, remains in place as the coating formed in a process according to the invention.

A working composition according to the invention may be applied to a metal work piece and dried thereon by any convenient method, several of which will be readily apparent to those skilled in the art. For example, coating the metal with a liquid film may be accomplished by immersing the surface in a container of the liquid composition, spraying the composition on the surface, coating the surface by passing it between upper and lower rollers with the lower roller immersed in a container of the liquid composition, and the like, or by a mixture of methods. Excessive amounts of the liquid composition that might otherwise remain on the surface prior to drying may be removed before drying by any convenient method, such as drainage under the influence of gravity, squeegees, passing between rolls, and the like. Drying also may be accomplished by any convenient method, such as a hot air oven, exposure to infra-red radiation, microwave heating, and the like.

For flat and particularly continuous flat workpieces such as sheet and coil stock, application by a roller set in any of several conventional arrangements, followed by drying in a separate stage, is generally preferred. The temperature during application of the liquid composition may be any temperature within the liquid range of the composition, although for convenience and economy in application by roller coating, normal room temperature, i.e., from 20–30° C., is usually preferred. In most cases for continuous processing of coils, rapid operation is favored, and in such cases drying by infrared radiative heating, to produce a peak metal temperature that is at least, with increasing preference in the order given, 20, 30, 40, 50, 60, 70, 80, 85, or 90° C. and independently preferably is not more than, with increasing preference in the order given, 160,150, 145, 140, 135, 130, or 125° C. Any other method of heating, for example a hot air oven, may be used, preferably to achieve the same peak metal temperature.

Alternatively, particularly if the shape of the substrate is not suitable for roll coating, a composition may be sprayed onto the surface of the substrate, which may optionally be preheated, and allowed to dry in place; such cycles can be repeated as often as needed until the desired amount of coating, generally measured in grams of coating per square meter of substrate surface coated (a unit of measurement hereinafter usually abbreviated as "$g/m^2$"), is achieved. For this type of operation, the same peak metal temperatures as specified in the immediately preceding paragraph are preferred.

The amount of dry add-on mass per unit area of substrate surface treated (often alternatively called "coating weight") in a process according to the invention preferably is at least, with increasing preference in the order given, 0.10, 0.20, 0.30, 0.40, 0.50, 0.75, 1.00, 1.25, 1.50, 1.75, 1.85, 1.95, 2.05, or 2.10 $g/m^2$ and independently, particularly if the substrate is intended to receive another conversion coating after being mechanically shaped subsequent to a process according to the invention, preferably is not more than, with increasing preference in the order given, 10, 8, 6, 4, 3.5, 3.0, or 2.5 Preferably, the metal surface to be treated according to the invention is first cleaned of any contaminants, particularly organic contaminants and foreign metal fines and/or inclusions. Such cleaning may be, accomplished by methods known to those skilled in the art and adapted to the particular type of metal substrate to be treated. For example, for galvanized steel surfaces, the substrate is most preferably cleaned with a conventional hot alkaline cleaner, then rinsed with hot water, squeegeed, and dried. For aluminum, the surface to be treated most preferably is first contacted with a conventional hot alkaline cleaner, then rinsed in hot water, then, optionally, contacted with a neutralizing acid rinse, before being contacted with a composition according to the invention as described above.

The invention is particularly well adapted to treating surfaces that are to be subsequently formed into a different shape by mechanical processes, particularly when they are further protected by forming an additional conversion coating, and, optionally but usually, at least one further protective coating of paint or a similar material with an organic binder phase. As with prior art phosphate containing coatings used for this purpose, coatings produced according to the invention preferably are lubricated with a conventional oil lubricant before being mechanically formed.

The invention may be further appreciated by consideration of the following working and comparison examples.

Concentrate Compositions

A concentrate of a conventional phosphating composition used in preparing a composition according to the invention had the chemical characteristics shown in Table 1. In addition to this, a commercial product, BONDERITE® 5893, available from the Henkel Surface Technologies Div. of Henkel Corp., Madison Heights, Mich. was used for this purpose in preparing some of the compositions according to the invention. This material is designated as Conventional Phosphating Concentrate (hereinafter usually abbreviated as "CPC") 2, while the concentrate defined in Table 1 is designated as CPC 1, in later tables.

TABLE 1

| Ingredient | Parts by Weight of Ingredient in Concentrate: |
|---|---|
| Deionized water | 2142 |
| Ferrous sulfate heptahydrate | 12 |
| Calcium carbonate | 400 |
| 75% $H_3PO_4$ in water | 1296 |

Note for Table 1
During the course of preparation of Concentrate 1, gas evolution, which is believed to be due to the expulsion from the concentrate of the stoichiometric equivalent as carbon dioxide of the amount of calcium carbonate added, occurs, so that the final conventional concentrate weighs slightly less than the sum of the ingredients added to make it.

Candidate concentrate compositions according to the invention were made from these concentrates for conventional phosphating processes and the additives characteristic of the invention. These candidate concentrate compositions are detailed in Table 2 below.

Working Compositions and Processes

Some of the concentrate compositions shown in Table 2 were used as working compositions, in some instances after dilution with deionized water to provide a concentration of the concentrate as low as 20%. These working compositions were applied to flat hot-dip galvanized panels with a draw bar to apply a coating of substantially even thickness, which was then dried into place on the panels in a hot air oven at a temperature.

TABLE 2

CANDIDATE CONCENTRATES ACCORDING TO THE INVENTION

| Concentrate No. | Parts by Weight in Concentrate of: CPC 1 | CPC 2 | PE 1 | PE 2 | WE 1 | WE 2 | WE 3 | Observations |
|---|---|---|---|---|---|---|---|---|
| 1 | 50 | | 1 | | | | | Clear |
| 2 | 50 | | 10 | | | | | Viscous, clear |
| 3 | 50 | | | 1 | | | | PhsSep; U |
| 4 | 50 | | | | 0.50 | | | ClSu, nps |
| 5 | 50 | | | | | 0.50 | | ClSu, nps |
| 6 | | 50 | | | 2.8 | | | nps |
| 7 | | 50 | | | | | 4.0 | nps |
| 8 | | 50 | | | | 3.9 | | nps |
| 9 | | 50 | | | 1.4 | | | nps |
| 10 | | 50 | | | | | 2.0 | nps |
| 11 | | 50 | | | | 1.5 | | nps |
| 12 | 50 | | | | | | 2.0 | nps |

Additional Abbreviations for Table 2

"PE 1" means "ETHOX ™ 2684 surfactant", commercially supplied by Ethox Chemicals, Inc. and reported by its supplier to be mixed esters of phosphoric acid with alcohol molecules having (i) a hydrophobe portion with 8 to 10 carbon atoms and (ii) a polyoxyethylene block with an average of 6 oxyethylene units, the average molecular weight of the total surfactant being about 490.

"PE 2" means "ETHFAC ™ 136 surfactant", commercially supplied by Ethox Chemicals, Inc. and reported by its supplier to be mixed esters of phosphoric acid with alcohol molecules having (i) a hydrophobe portion with an average of 6 carbon atoms and (ii) a polyoxyethylene block with an average of 3 oxyethylene units, the average molecular weight of the total surfactant being about 315.

"WE 1" means "Poly Emulsion 20C35", commercially supplied by ChemCor, Chester, New York and reported by its supplier to be an emulsion with a cationic emulsifying agent of a medium high density polyethylene, containing about 35% non-volatiles.

"WE 2" means "Poly Emulsion 191C30", commercially supplied by ChemCor, Chester, New York and reported by its supplier to be an emulsion with a cationic emulsifying agent of a high density crystalline linear polyethylene, containing about 30% non-volatiles.

"WE 3" means "Poly Emulsion 540C25", commercially supplied by ChemCor, Chester, New York and reported by its supplier to be an emulsion with a cationic emulsifying agent of a copolymer of ethylene and acrylic acid, containing about 25% non-volatiles.

"PhsSep" means "phase separation observed"; "U" means "unsatisfactory"; "ClSu" means "cloudy suspension"; "nps" means "no phase separation observed".

of 90–125° C. The mass of the dry coating per unit area of the surface coated is shown in Table 3.

Before measuring the coefficients of friction for the substrates processed according to the invention, the dried surfaces produced as described above were liberally

TABLE 3

COATING WEIGHTS AND RESULTING COEFFICIENTS OF FRICTION

| Working Composition No. | Grams of Dry Coating per Square Meter of Substrate | Coefficient of Friction |
|---|---|---|
| 1 | 1.1 | 0.106 |
| | 2.1 | 0.092 |
| 2 | 1.1 | 0.111 |
| | 2.1 | 0.084 |
| 5 | 1.1 | 0.107 |
| | 2.1 | 0.087 |
| 6 | 1.1 | 0.113 |
| | 2.1 | 0.092 |
| CPC 2 | 1.3 | 0.116 |
| | 1.8 | 0.125 |

TABLE 3-continued

COATING WEIGHTS AND RESULTING COEFFICIENTS OF FRICTION

| Working Composition No. | Grams of Dry Coating per Square Meter of Substrate | Coefficient of Friction |
|---|---|---|
| CPC 1 | 1.1 | 0.111 |
| | 2.1 | 0.119 |

Note for Table 3

The composition numbers in this table that consist of a single digit indicate the compositions identified by the same number in Table 2.

coated with FERROCOTE™ 61 AUS press oil. The coefficients of sliding friction were then measured on a mechanical draw bench in a manner generally known in the art, by measuring the minimum force required to cause the tested panel to slide along the bench under a heavy weight, which contacted the surface of the tested panel over a known area and therefore exerted a known vertical pressure of about 69 bars against the surface. Two samples were measured for each set of conditions, and the average coefficients of friction measured are also shown in Table 3. It is clear from the values in Table 3 that all of the compositions according to the invention shown there result in substantially lower coefficients of friction than the otherwise similar conventional phosphating compositions denoted as "CPC 1" and "CPC 2" at the higher values shown for coating mass per unit area, and that all but the last of them achieves an improvement in this property even at the lower coating mass per unit area shown, although this improvement is less than with the higher coating mass per unit area.

What is claimed is:

1. A process for forming a phosphate conversion coating on a surface of a metal substrate, said process comprising operations of:

(I) covering the surface of the metal substrate with a layer of a liquid composition that comprises water and the following components:

(A) a component of dissolved phosphate ions; and (B) a component of additive selected from the group consisting of:

dissolved phosphate esters and dispersed phosphate esters; and dispersed natural and synthetic waxes that are not phosphate esters; and (II) drying into place on the surface of the metal substrate the non-volatiles content of the layer of said liquid composition formed over said surface in operation (I), without any intermediate rinsing, to form a dry phosphate conversion coating on said surface of the metal substrate.

2. A process according to claim 1, wherein, in said liquid composition:

there is a concentration of dissolved calcium cations that is within a range from about 0.10 to about 10 M/kg; and there is at least one of:

a concentration of phosphate esters that is within a range from about 3.0 to about 300 ppt; and a concentration of waxes that are not phosphate esters that is within a range from about 0.5 to about 50 ppt.

3. A process according to claim 2, wherein, in said liquid composition, there is at least one of:

a concentration that is within a range from about 15 to about 80 ppt of phosphate esters that are selected from the group consisting of esters of alcohols that:

include on average in each molecule a block of polyoxyethylene that contains at least 4 and not more than 12 oxyethylene units in the block; and also include in each molecule a hydrophobe portion, bonded to one end of said block of polyoxyethylene, said hydrophobe portion containing only carbon and hydrogen atoms and, optionally, halogen atoms, the number of carbon atoms in the hydrophobe portion being at least 6 and not more than 18; and a concentration that is within a range from about 2.0 to about 30 ppt of waxes that:

are not phosphate esters; and have a weight average molecular weight that corresponds to at least 200 carbon atoms per molecule.

4. A process according to claim 3, wherein, in said liquid composition:

there is a concentration of dissolved calcium cations that is within a range from about 0.40 to about 1.10 M/kg;

there is a concentration of ferrous cations that is within a range from about 1.9 to about 3.1 ppt; and there is at least one of:

a concentration that is within a range from about 30 to about 55 ppt of phosphate esters that are selected from the group consisting of esters of alcohols that:

include on average in each molecule a block of polyoxyethylene that contains at least 5 and not more than 7 oxyethylene units in the block; and also include in each molecule a hydrophobe portion, bonded to one end of said block of polyoxyethylene, said hydrophobe portion containing only carbon and hydrogen atoms, the number of carbon atoms in the hydrophobe portion being at least 8 and not more than 10; and a concentration that is within a range from about 4.0 to about 12 ppt of waxes that:

are oxidized crystalline polyethylene waxes;

have a weight average molecular weight that corresponds to at least 200 carbon atoms per molecule; and are dispersed into water with a cationic dispersing agent.

5. A process for forming a phosphate conversion coating on a surface of a metal substrate, said process comprising operations of:

(I) covering the surface of the metal substrate with a layer of a liquid composition that has been made by mixing together with a first mass of water at least the following additional masses:

(A) a second mass of a source of dissolved phosphate ions; and (B) a third mass of additive selected from the group consisting of:

dissolved phosphate esters and dispersed phosphate esters; and dispersed natural and synthetic waxes that are not phosphate esters; and (II) drying into place on the surface of the metal substrate the non-volatiles content of the layer of said liquid composition formed over said surface in operation (I), without any intermediate rinsing to form a dry phosphate conversion coating on said surface of the metal substrate.

6. A process according to claim 5, wherein, in said liquid composition: there has been additionally mixed to form said composition a fourth mass of a source of dissolved calcium cations, said fourth mass containing an amount of calcium cations that is within a range from about 0.10 to about 10 moles of calcium cations per kilogram of total composition; and said third mass includes at least one of:

a fifth mass of phosphate esters, said fifth mass constituting from about 3.0 to about 300 ppt of the total composition; and a sixth mass of waxes that are not phosphate esters, said sixth mass constituting from about 0.5 to about 50 ppt of the total composition.

7. A [composition]process according to claim 6, wherein there has been mixed into said liquid composition at least one of:

a fifth mass that constitutes from about 15 to about 80 ppt of the total composition, the phosphate esters of said fifth mass being selected from the group consisting of esters of alcohols that:

include on average in each molecule a block of polyoxyethylene that contains at least 4 and not more than 12 oxyethylene units in the block; and also include in each molecule a hydrophobe portion, bonded to one end of said block of polyoxyethylene, said hydrophobe portion containing only carbon and hydrogen atoms and, optionally, halogen atoms, the number of carbon atoms in the hydrophobe portion being at least 6 and not more than 18; and a sixth mass that constitutes from about 2.0 to about 30 ppt of the total composition, said sixth mass being selected from the group consisting of waxes that:

are not phosphate esters; and have a weight average molecular weight that corresponds to at least 200 carbon atoms per molecule.

8. A process according to claim 7, wherein:

said fourth mass contains an amount of calcium cations that corresponds to from about 0.40 to about 1.10 moles of calcium cations per kilogram of total composition;

there has been mixed into said composition a seventh mass of a source of dissolved ferrous cations, said seventh mass containing an amount of ferrous cations that constitutes from about 1.9 to about 3.1 ppt of the total composition; and there has been mixed into said composition at least one of:

a mass that constitutes from about 30 to about 55 ppt of the total composition and has been selected from the group consisting of esters of alcohols that:

include on average in each molecule a block of polyoxyethylene that contains at least 5 and not more than 7 oxyethylene units in the block; and also include in each molecule a hydrophobe portion, bonded to one end of said block of polyoxyethylene, said hydrophobe portion containing only carbon and hydrogen atoms, the number of carbon atoms in the hydrophobe portion being at least 8 and not more than 10; and a mass that constitutes from about 4.0 to about 12 ppt of the total composition and consists of waxes that:

are oxidized crystalline polyethylene waxes;

have a weight average molecular weight that corresponds to at least 200 carbon atoms per molecule; and are dispersed into water with a cationic dispersing agent.

9. A process according to claim 8, wherein the source of dissolved phosphate ions is orthophosphoric acid, the source of calcium ions is calcium carbonate, and the source of ferrous cations is ferrous sulfate.

10. A process according to claim 9, wherein the dry phosphate conversion coating formed on said surface of the metal substrate has, after being lubricated, a lower coefficient of sliding friction than does an equally lubricated dry phosphate conversion coating formed by a reference process which is identical except that the liquid composition used in the reference process does nor contain any dispersed wax or dissolved or dispersed phosphate ester.

11. A process according to claim 8, wherein the dry phosphate conversion coating formed on said surface of the metal substrate has, after being lubricated, a lower coefficient of sliding friction than does an equally lubricated dry phosphate conversion coating formed by a reference process which is identical except that the liquid composition used in the reference process does not contain any dispersed wax or dissolved or dispersed phosphate ester.

12. A process according to claim 7, wherein the dry phosphate conversion coating formed on said surface of the metal substrate has, after being lubricated, a lower coefficient of sliding friction than does an equally lubricated dry phosphate conversion coating formed by a reference process which is identical except that the liquid composition used in the reference process does not contain any dispersed wax or dissolved or dispersed phosphate ester.

13. A process according to claim 6, wherein the dry phosphate conversion coating formed on said surface of the metal substrate has, after being lubricated, a lower coefficient of sliding friction than does an equally lubricated dry phosphate conversion coating formed by a reference process which is identical except that the liquid composition used in the reference process does not contain any dispersed wax or dissolved or dispersed phosphate ester.

14. A process according to claim 5, wherein the dry phosphate conversion coating formed on said surface of the metal substrate has, after being lubricated, a lower coefficient of sliding friction than does an equally lubricated dry phosphate conversion coating formed by a reference process which is identical except that the liquid composition used in the reference process does not contain any dispersed wax or dissolved or dispersed phosphate ester.

15. A process according to claim 4, wherein the dry phosphate conversion coating formed on said surface of the metal substrate has, after being lubricated, a lower coefficient of sliding friction than does an equally lubricated dry phosphate conversion coating formed by a reference process which is identical except that the liquid composition used in the reference process does not contain any dispersed wax or dissolved or dispersed phosphate ester.

16. A process according to claim 3, wherein the dry phosphate conversion coating formed on said surface of the metal substrate has, after being lubricated, a lower coefficient of sliding friction than does an equally lubricated dry phosphate conversion coating formed by a reference process which is identical except that the liquid composition used in the reference process does not contain any dispersed wax or dissolved or dispersed phosphate ester.

17. A process according to claim 2, wherein the dry phosphate conversion coating formed on said surface of the metal substrate has, after being lubricated, a lower coefficient of sliding friction than does an equally lubricated dry phosphate conversion coating formed by a reference process which is identical except that the liquid composition used in the reference process does nor contain any dispersed wax or dissolved or dispersed phosphate ester.

18. A process according to claim 1, wherein the dry phosphate conversion coating formed on said surface of the metal substrate has, after being lubricated, a lower coefficient of sliding friction than does an equally lubricated dry phosphate conversion coating formed by a reference process which is identical except that the liquid composition used in the reference process does not contain any dispersed wax or dissolved or dispersed phosphate ester.

19. A process according to claim 18, wherein:

the liquid composition used in operation (I) has a concentration of phosphate ions that is from about 2.0 to about 4.0 M/kg;

the metal substrate reaches a peak temperature during the process that is within a range from about 70 to about 150° C.; and the coating formed after drying has a mass per unit area that is at least 1.75 $g/M^2$ and is not more than about 10 $g/m^2$.

20. A process according to claim 1, wherein:

the liquid composition used in operation (I) has a concentration of phosphate ions that is from about 2.0 to about 4.0 M/kg;

the metal substrate reaches a peak temperature during the process that is within a range from about 70 to about 150° C.; and the coating formed after drying has a mass per unit area that is at least 1.75 $g/m^2$ and is not more than about 10 $g/m^2$.

* * * * *

UNITED STATES PATENT AND TRADEMARK OFFICE

CERTIFICATE OF CORRECTION

PATENT NO. : 6,478,885 B1
DATED : November 12, 2002
INVENTOR(S) : Goodreau

It is certified that error appears in the above-identified patent and that said Letters Patent is hereby corrected as shown below:

Column 11,
Line 58, after "rinsing", insert therefor -- , --.

Column 12,
Line 8, delete "[composition]".

Column 13,
Line 4, delete "nor", and insert therefor -- not --.

Column 14,
Line 17, delete "nor", and insert therefor -- nor --.
Line 33, delete "$g/M^2$", and insert therefor -- $g/m^2$ --.

Signed and Sealed this

Third Day of February, 2004

JON W. DUDAS
*Acting Director of the United States Patent and Trademark Office*